United States Patent [19]

Bielagus

[11] Patent Number: 4,755,286

[45] Date of Patent: Jul. 5, 1988

[54] SPLIT FLOW 'V' SCREEN

[75] Inventor: Joseph B. Bielagus, Tualatin, Oreg.

[73] Assignee: Beloit Corporation, Beloit, Wis.

[21] Appl. No.: 79,858

[22] Filed: Jul. 30, 1987

[51] Int. Cl.[4] ..... B07B 1/16

[52] U.S. Cl. ..... 209/243; 209/672

[58] Field of Search ..... 162/55; 209/243, 253, 209/271, 311, 315, 353, 355, 667, 672

[56] References Cited

U.S. PATENT DOCUMENTS

| | | | |
|---|---|---|---|
| 2,819,846 | 1/1958 | Smith | 209/253 |
| 3,779,381 | 12/1973 | Armstrong | 209/315 |
| 4,377,474 | 3/1983 | Lindberg | 209/672 |
| 4,452,694 | 6/1984 | Christensen et al. | 209/667 |
| 4,653,648 | 3/1987 | Bielagus | 209/672 |
| 4,658,965 | 4/1987 | Smith | 209/672 |

*Primary Examiner*—David L. Lacey
*Assistant Examiner*—K. M. Hastings
*Attorney, Agent, or Firm*—Dirk J. Veneman; Raymond W. Campbell

[57] ABSTRACT

A paper pulp processing mechanism and method for screening large flows of wood chips including a screening bed for receiving a delivery of a quantity of wood chips at a screening receiving station, the flow of chips dividing to flow laterally in one direction over a first lateral bed section extending laterally and upwardly and to also flow over a second lateral bed section extending laterally and upwardly with each section extending away from the receiving station to a delivery end and each path defined by a plurality of laterally extending rotatable shafts having disks thereon interdigitally related.

12 Claims, 1 Drawing Sheet

SPLIT FLOW 'V' SCREEN

BACKGROUND OF THE INVENTION

The present invention relates to improvements in disk screens for screening or classifying wood chips in a paper machine.

Disk screens are desirable apparatus for screening or classifying discrete materials such as paper pulp, municipal wastes, and the like, such screens comprise a screening bed having a series of corotating spaced parallel shafts each of which has a longitudinal series of concentric screen disks which interdigitate with the screen disks of the adjacent shafts. Spaces between the disks permit only material of acceptable size to pass downwardly through the rotating disks bed, and since the disks are all driven to rotate in a common direction from the infeed in end of the screen bed to the outfeed or discharge end of the bed, the particles of material which are larger than the acceptable sizes of material will be advanced on the bed to the outfeed end of the bed and rejected.

Screening devices for the screening of wood chips incorporating parallel rotating shafts with interdigitated disks thereon have been known and various developments have been made including arrangements for the improved mounting of disks on the shaft such as, for example, disclosed in my copending application, Ser. No. 724,098, filed Apr. 17, 1985, which issued Mar. 31, 1987, as U.S. Pat. No. 4,653,648.

Difficulty has been encountered in existing disk screens. One problem which exists is that the volumes of flow which have to be accommodate tend to carry over acceptable material that should pass through the screen. With increases in sizes which are necessary to handle large volumes of flow, the screens generally consume substantial building space to process the required volume of material. Changes in design which include the arrangement of shafts oriented perpendicular to the material flow allow a substantial lower quantity of acceptable chips to pass over the screen, but because of the aggressive nature of the structure, over-thick chips pass through with the accepts lowering over-thick removal efficiencies.

It is accordingly an object of the present invention to provide an improved structure and method for disk screening of chips.

A further object of the invention is to provide an improved screen wherein the operating efficiency is improved and horsepower input consumption is reduced.

A further object of the invention is to provide a disk screen arrangement wherein removal efficiencies are improved in spite of heavy deliveries of material and with short retention time of material on the screen surface.

FIELD OF THE INVENTION

In accordance with a feature of the invention, a disk screen arrangement is provided wherein a multiple screen line is arranged with plural lines leading from a common delivery point. This is accomplished by arranging a plurality of screens which consist of shafts oriented perpendicular to the material flow that the material divides into two lateral bed sections extending laterally and upwardly from the receiving station. Each of the bed sections inclines upwardly uniformly and at an equal angle so that the heavy flow of wood chips divides into two flows so that the bed depth for each side is cut in half thereby increasing the throughput capacity for the same open area which leads to reduced acceptable chip carryover. Further increased screen open area is achieved due to the additional interface at the nip point of the V formed by the two laterally extending bed sections. With relatively short retention time of the material on the screen surface, improved over-thick removal efficiencies are achieved. Further, it has been discovered that reduced horsepower requirements are achieved due to the amount of work done on the material to provide the required screening and in test arrangements, removal efficiency of 15% to 20% over previous performance evaluations have been achieved. Further, reduced frame weight and improved design leading to easier maintenance is accomplished.

Other objects, advantages and features will become more apparent with the teaching of the principles of the present invention in connection with the disclosure of the preferred embodiments thereof in the specification, claims and drawings, in which:

DESCRIPTION OF THE PREFERRED EMBODIMENTS

Figure 1:
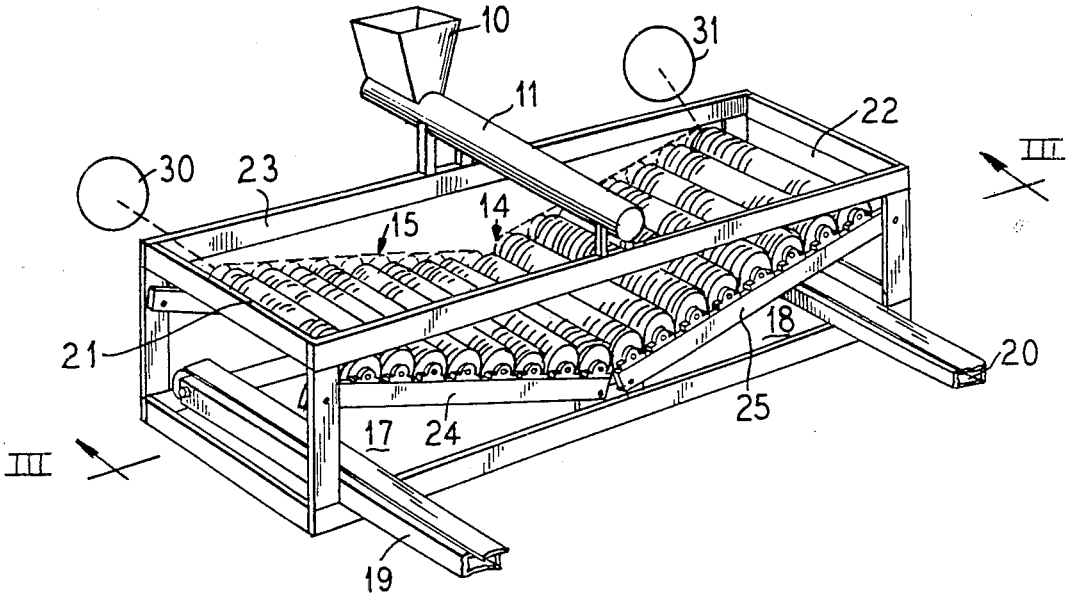
FIG. 1 is a perspective view of a structure constructed and operating in accordance with the principles of the present invention for the disk screening of chips.
Figure 2:
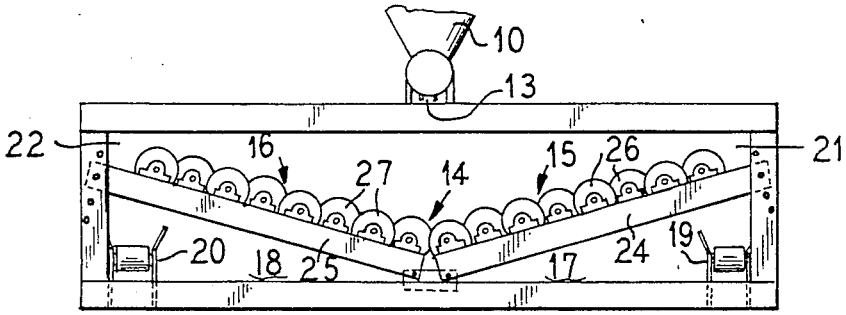
FIG. 2 is a rear elevational view taken from the back of the machine of FIG. 1.

As illustrated in the drawings, chips to be screened are fed into a hopper 10 which leads down to a closed tubular screw conveyor 11. The screw conveyor has a distributing advancing auger 12 therein for moving the chips forward and dropping them uniformly along the width of the machine. For this purpose, a slot 13 is provided at the bottom of the auger and by the determination of the width of the slot, the size of the auger 12 and its tube 11, the chips will be uniformly distributed across the machine as the auger continues rotation and as a continual supply of chips is fed into the hopper 10.

Chips drop downwardly onto the screening bed, particularly drop down on to a central receiving station shown generally at 14. At the receiving station, the flow of chips divides so that substantially one-half flows upwardly in one direction and the other half in the opposite direction.

Leading laterally and upwardly from the central receiving station 14 is a first lateral bed section 15 which defines a first screening path extending from the station 14 to a delivery end 21 which is spaced from the receiving station. While the chips are passing laterally outwardly and upwardly, they are being screened between the rotating disks which are shown generally at 26 and 27.

Figure 3:
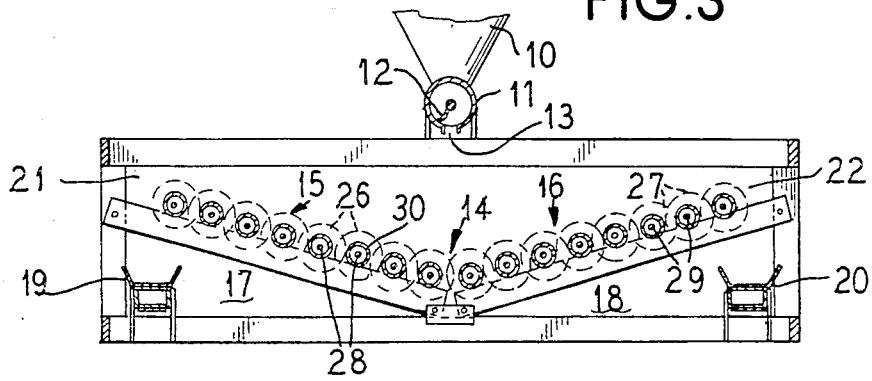
FIG. 3 is a vertical sectional view taken substantially along line III—III of FIG. 1.

The other portion of the chips flows upwardly to the right, as shown in FIGS. 1 and 3 over a second lateral bed section which defines a second screening path extending laterally and upwardly from the receiving station 14 to a delivery end 21 spaced from the station 14.

Each of the bed sections include a plurality of shafts shown at 28 for the first bed 15 and shown at 29 for the second bed 16. These shafts extend horizontally and transversely or at right angles to the movement of the chips.

On the shafts are a plurality of screening disks which are uniformly spaced along each of the shafts and which are interdigitally related as shown generally in FIG. 3. The disks may take various forms and may have various forms of mounting on the shaft and by way of example, reference may be made to the aforementioned U.S. Pat. No. 4,653,648.

As the chips are screened, the accepts fall downwardly in the area indicated at 17 and 18. Suitable means are provided downwardly of the screening mechanism for receiving the acceptable chips.

The rejects continue to move outwardly and upwardly on the rotating disks to where they pass over the end of the last set of disks at each end shown at 21 and 22. These rejects drops downwardly onto laterally extending conveyor belts shown at 19 and 20. The conveyor belts continue to convey the nonacceptable chips away to a suitable receiver for further processing.

Disks in each of the bed sections are each driven by a common drive shown at 30 for the first lateral bed section 15 and shown at 31 for the second lateral bed section 16. The disks in each of the bed sections are rotated in the same direction for each section, with the disks on the left rotating to advance chips upwardly toward the end 21 and the disks on the right rotating oppositely to advance chips toward the end 22.

While various forms of structures for mechanical support of the parts may be employed, for purposes of illustration, the mechanism is shown supported on the generally rectangular frame 23 which supports the conveyors 19 and 20 and the chip delivery mechanism 11. At each side of the frame are sloping support bars 24 for the first bed and 25 for the second bed, and these support bars carry bearings for the shafts on which the disks are mounted. Suitable interconnecting gears are provided for the shafts of each section.

The individual disks shown at 26 and 27 for the sections are mounted on the shafts and are suitably supported and separated from each other such as by bushings 28 and 29 shown somewhat schematically in FIG. 3, and the bushings may be somewhate flexible to allow for limited deflection of the disks.

Various angles of incline may be employed, but generally a preferred inclination of each of the beds is in the range of between 0° and 30°.

Various angles of inclination may be used, but preferably the angle of each of the beds is the same for each side of the mechanism, and preferably the inclination is uniform throughout the bed.

With this arrangement, the bed depth of the material delivered is essentially cut in half with each half passing up each side of the first and second lateral bed sections respectively. The arrangement also results in increased screen open area due to the additional interface at the nip point of the V generally at 14. Higher capacities have been achieved because of the arrangement and inclination of the beds and unexpectedly, the removal efficiency has been increased 15% to 20% over performance of previous arrangements.

Thus, it will be seen that there has been provided an improved processing mechanism for screening large flow of wood chips which meets the objectives and advantages above set forth.

I claim as my invention:

1. A mechanism for screening large flows of wood chips, comprising in combination:

a screening bed having a width for receiving the delivery of a quantity of wood chips at a screening receiving station;

means for distributing the large flow of wood chips substantially evenly over said screening receiving station, said distributing means extending over substantially the entire width of said screening bed;

a first lateral bed section extending laterally and upwardly defining a first screening path extending from said station to a first delivery end spaced from said station, said first screening path including means for passing rejected chips off said first lateral bed section at said first delivery end;

a second lateral bed section defining a second screening path extending laterally and upwardly from said station in a direction opposite said first bed section to a second delivery end spaced from said station, said second screening path including means for passing rejected chips off said second lateral bed section at said second delivery end;

each of said bed sections including a plurality of shafts extending transversely of said path and rotatable in a common direction within each section;

each shaft having a plurality of screening disks on the shaft and interdigitally related to screening disks on adjacent shafts whereby chips proceed to be screened as they are moved laterally and upwardly in both screen paths from the common receiving station toward said first and second delivery ends; and disks of an end shaft of said first bed section interdigitating with disks of an end shaft of said second bed section and said interdigitated disks of said end shafts of said first and second bed sections forming said screening receiving station.

2. A mechanism for screening large flows of wood chips constructed in accordance with claim 1:

wherein said disks are flexibly mounted on the shafts.

3. A mechanism for screening large flows of wood chips constructed in accordance with claim 1:

wherein said bed sections extend upwardly between said receiving station and said first and second delivery ends at an inclination between the angles of 0° and 30°.

4. A mechanism for screening large flows of wood chips constructed in accordance with claim 1:

wherein each of said first and second bed sections inclines upwardly at the same angle from said receiving station to said first and second delivery ends, respectively.

5. A mechanism for screening large flows of wood chips constructed in accordance with claim 1:

wherein each of said beds inclines upwardly at a uniform angle throughout the length of the bed section.

6. A mechanism for screening large flows of wood chips constructed in accordance with claim 1:

wherein said shafts are equally spaced from each other.

7. A mechanism for screening large flows of wood chips constructed in accordance with claim 1:

wherein said disks are of the same diameter.

8. A mechanism for screening large flows of wood chips constructed in accordance with claim 1:

wherein a common drive is provided for each of said shafts in each section.

9. A method of screening large flows of wood chips on a disk screen including a plurality of rotatable shafts each having disks thereon, with disks of adjacent shafts interdigitating and defining a screening bed having a width, said method comprising the steps:

delivering a large flow of wood chips to be screened to a common receiving station extending over substantially the entire width of the screening bed;

distributing the flow of chips substantially uniformly in the common receiving station;

separating the flow of chips in the common receiving station into two substantially equal divided flows;

and passing the divided flows of chips laterally and upwardly in opposed directions from the receiving station, with a first divided flow passing over a first screening path disposed transversely to said shafts and formed by a first lateral bed section of said screening bed extending laterally and upwardly from said station to an upper end of said first lateral bed section and a second divided flow passing over a second screening path disposed transversely to said shafts and formed by a second lateral bed section of said screening bed extending laterally and upwardly from said receiving station to an upper end of said second lateral bed section; screening the chips in both divided flows simultaneously from the common receiving station; and passing rejected chips from said upper ends of said first and second lateral bed sections.

10. The method of screening large flows of wood chips in a paper pulp processing operation in accordance with the steps of claim 9:

wherein said paths extend upwardly at an angle in the range of between 0° to 30°.

11. The method of screening large flows of wood chips in a paper pulp processing operation in accordance with the steps of claim 9:

wherein said paths extend laterally and upwardly at equal angles from said station.

12. The method of screening large flows of wood chips in a paper pulp processing operation in accordance with the steps of claim 9:

wherein said paths incline upwardly at a uniform rate.

* * * * *